United States Patent [19]

Penterman

[11] Patent Number: 4,667,358

[45] Date of Patent: May 26, 1987

[54] WATER BED WITH WAVE GENERATION AND CONTROL MECHANISM

[76] Inventor: Dennis P. Penterman, 13235 W. Burleigh, Brookfield, Wis. 53005

[21] Appl. No.: 744,033

[22] Filed: Jun. 12, 1985

[51] Int. Cl.[4] ..... A47C 21/00; A47C 27/08; A61H 1/00

[52] U.S. Cl. ..... 5/508; 5/451; 5/109; 128/33

[58] Field of Search ..... 5/108, 109, 451, 508; 128/33, 41, 64

[56] References Cited

U.S. PATENT DOCUMENTS

| | | | |
|---|---|---|---|
| 3,085,568 | 4/1963 | Whitesell . | |
| 3,096,758 | 7/1963 | Savage | 128/41 |
| 3,317,934 | 5/1967 | Hinrichs . | |
| 3,872,526 | 3/1975 | Betts . | |
| 4,005,703 | 2/1977 | Rosen et al. | 128/33 |
| 4,048,684 | 9/1977 | Korner et al. . | |
| 4,079,728 | 3/1978 | Gatts . | |
| 4,105,024 | 8/1978 | Raffel . | |
| 4,114,215 | 9/1978 | Santo . | |
| 4,120,062 | 11/1978 | Anderson . | |
| 4,135,500 | 1/1979 | Gorran . | |
| 4,141,096 | 2/1979 | Hale et al. . | |
| 4,187,568 | 2/1980 | McMullan et al. . | |
| 4,231,126 | 8/1980 | Hurkett . | |
| 4,370,602 | 1/1983 | Jones, Jr. et al. | 128/41 |

*Primary Examiner*—Gary L. Smith
*Assistant Examiner*—Michael F. Trettel
*Attorney, Agent, or Firm*—Andrus, Sceales, Starke & Sawall

[57] ABSTRACT

A water bed mattress is caused to undulate for therapeutic or other purposes. A solenoid (14) is mounted at one end of the water bed (head or foot), and its output shaft (15) and mattress engaging pad or pusher plate (16) are disposed at an angle so that the pad forms an acute angle with the horizontal. The pad is thus engaged by oncoming waves form the remote end of the bed in a more facing type direction, which lessens the lateral stresses on the said output shafts. The solenoid is actuated by a control device (18) which provides a generally square electrical wave control signal and which utilizes independent variable TIME ON and TIME OFF modes providing maximum flexibility of solenoid operation.

1 Claim, 4 Drawing Figures

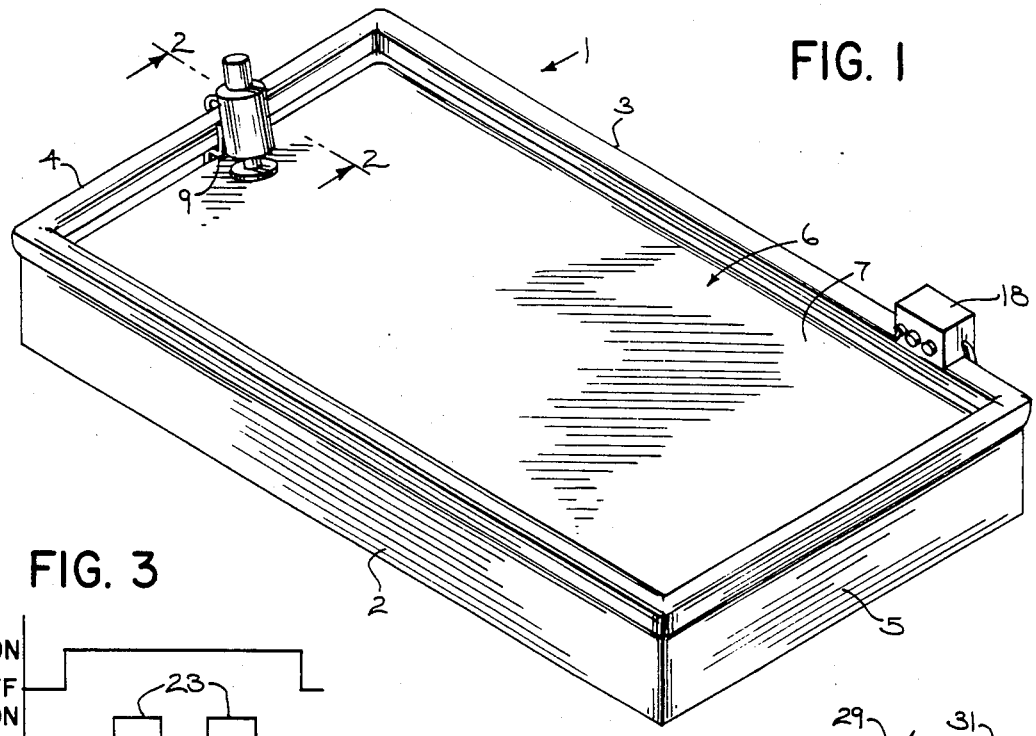
FIG. 1
FIG. 3
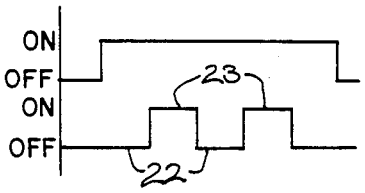
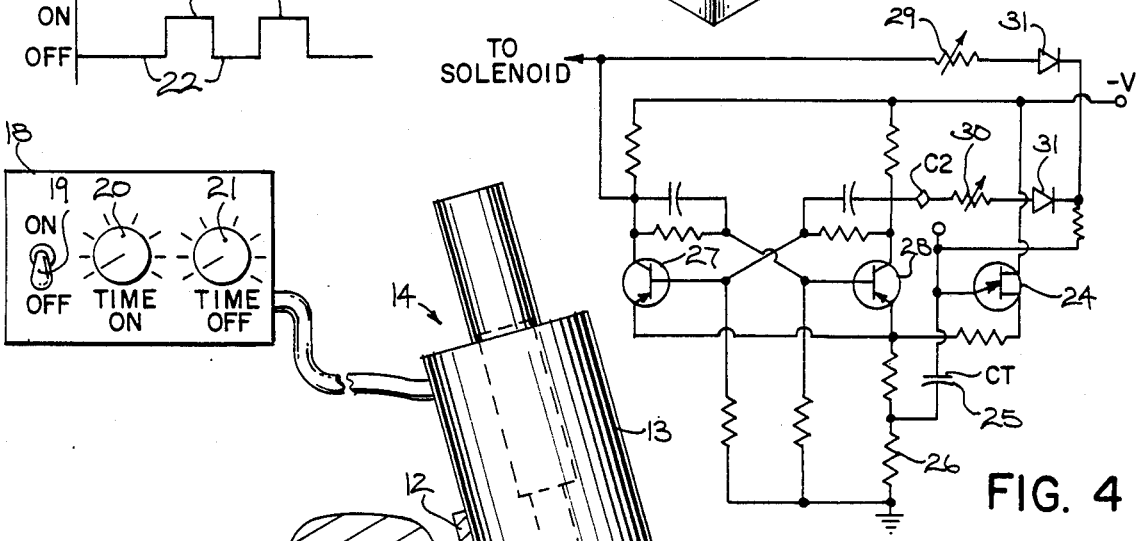
FIG. 4
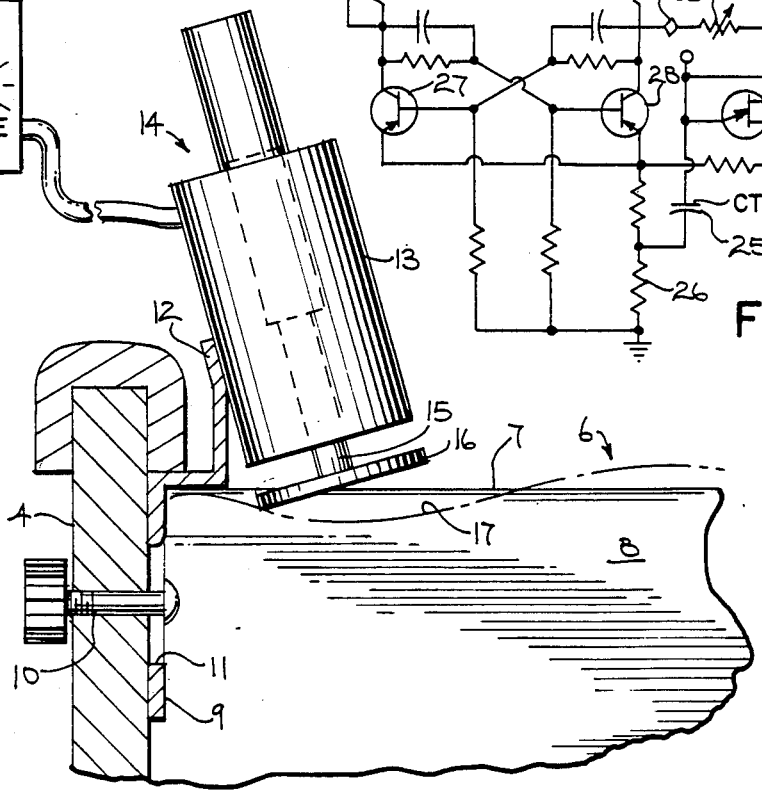
FIG. 2

WATER BED WITH WAVE GENERATION AND CONTROL MECHANISM

BACKGROUND AND SUMMARY

This invention relates to a water bed with a wave generation and control mechanism.

Numerous devices have been developed over the years for use with a water bed wherein the water-enclosing mattress is caused to undulate for therapeutic, wake-up alarm or other reasons. See, for example, U.S. Pat. No. 4,231,126 entitled "Water Bed Wave Generator". In that patent, a horizontal pad rests on the top surface of the mattress midway of its length and is operated to form waves in the water of the bed. The actuating pad is connected via a vertical shaft to a suitably actuatable mechanical gear motor, which tends to be very noisy and disturbing to the user. Futhermore, the mattress engaging pad, being horizontal, is subject to strong lateral forces from the waves formed at the top of the mattress. These buffetting forces may tend to weaken or distort the said pad and vertical shaft over a period of time. In addition, although the said '126 patent indicates that solenoids could replace the controller which operates the gear motor, there is no suggestion as to how this could be accomplished. The quiet feature of properly controlled solenoids would of course be an advantage.

It is an object of the present invention to solve the problems of noise, vertical shaft distortion and proper control of the wave generating device.

In accordance with the various aspects of the invention, a solenoid is mounted at one end of the water bed (head or foot), and its output shaft and mattress engaging pad or pusher plate are disposed at an angle so that the pad forms an acute angle with the horizontal. The pad is thus engaged by oncoming waves from the remote end of the bed in a more facing type direction, which lessens the lateral stresses on the said output shaft. The solenoid unit itself is mounted for generally vertical adjustment on a bracket secured to the respective end of the bed frame.

In addition, the solenoid is actuated by a control device which provides a generally square electrical wave control signal and which utilizes independent variable TIME ON and TIME OFF modes providing maximum flexibility of solenoid operation.

BRIEF DESCRIPTION OF THE DRAWINGS

The accompanying drawings illustrate the best mode presently contemplated by the inventor for carrying out the invention.

In the drawings:

FIG. 1 is a perspective view of a water bed incorporating the various aspects of the invention;

FIG. 2 is an enlarged horizontal section taken on line 2—2 of FIG. 1;

FIG. 3 is a logic function diagram showing the solenoid control signals; and FIG. 4 is an electrical circuit diagram for the solenoid control.

DESCRIPTION OF THE PREFERRED EMBODIMENT

As shown in FIGS. 1 and 2, the aspects of the invention are incorporated in a water bed 1 which includes a frame having a bottom (not shown), side walls 2, 3, a head end wall 4 and a foot end wall 5. The water bed frame is adapted to support, both vertically and horizontally, a water bed mattress 6 of the conventional type having an outer envelope 7 of flexible plastic or the like which encloses a quantity of water 8.

It is desired that means be provided to undulate mattress 6 when someone is lying on it for purposes previously mentioned. For this purpose, a bracket 9 is suitably secured to one of the bed ends, in this case head end 4, as by a bolt 10 passing through end 4 and a bracket slot 11, thus permitting vertical bracket adjustment. The upper portion of bracket 9 is provided with an inclined flange 12 to which is suitably secured the housing 13 of a solenoid 14 of any suitable type having an output shaft 15. A pusher plate 16 is disposed at the outer or lower end portion of shaft 15 and in the embodiment shown is disposed in close proximity to and slightly above mattress 6. As will be explained hereinafter, means are provided to control the position of shaft 15 so that plate 16 engages envelope 7 in the desired reciprocating manner.

As can be best seen in FIG. 2, shaft 15 is disposed at an acute angle to the vertical, while pusher plate 16 is disposed at an acute angle to the horizontal, such as 15°–20°. Such a construction permits oncoming waves 17 from the end 5 remote from head end 4 to engage the bottom or outermost surface of plate 16 such that the axial force vector on shaft 15 is increased while the lateral force vector on shaft 15 is reduced, as compared with a vertically disposed solenoid and respective shaft as shown in the aforementioned patent. A less powerful motive means (solenoid 14) can thus be used because it is not necessary to push directly down at a right angle to mattress 6.

Referring also to FIG. 2, solenoid 14 is shown as controlled from a control box 18 to provide infinitely adjustable (within the range permitted) amplitude and frequency movements of shaft 15 and pusher plate 16. Box 18 has an ON-OFF switch 19, a TIME ON control knob 20 and a TIME OFF knob 21.

The timing unit connected to box 18 may be of any suitable construction adapted to establish a variable length energization or TIME ON of the solenoid 14 and a variable length de-energization or TIME OFF of the solenoid. The timing unit provides a generally square wave control signal such as shown in FIG. 3. In the illustrated embodiment, the low level signal 22 is assumed to establish de-energization of the solenoid and the OFF period, and the high level signal 23 provides energization of the ON period. The length of each of the signals of the TIME ON and the TIME OFF are separately adjustable.

Referring particularly to FIG. 4, a unijunction transistor circuit using conventional PNP transistors is shown connected in a non-symmetrical multivibrator circuit to establish a square wave signal generally as shown in FIG. 3. The circuit is shown with a conventional flip-flop circuit having a unijunction transistor 24 serving the timing and triggering function. Thus, each time the unijunction transistor 24 fires, it discharges a timing capacitor 25 which develops a control pulse signal across a trigger resistor 26, which in turn triggers the flip-flop circuit from the one state to the other. The flip-flop circuit is shown including a pair of PNP transistors 27 and 28 connected to alternately conduct in response to the firing of the unijunction transistor 24. In the illustrated embodiment, the variable resistors 29 and 30, which are controlled by knobs 20 and 21 form a means for separately adjusting the time of the high level signal and the time of the low level signal. The timing capacitor 25 is charged through the resistor 29 or 30, depending upon whichever is connected to the positive voltage collector of the two resistors 29 and 30. The diodes 31 in series with the resistors 29 and 30 isolate the other resistor from the timing capacitor 25 during the charging cycle. The alternate or two parts of the periods, that is, the ON level 23 and the OFF level 22, are set independently by adjusting the potentiometers or variable resistors 29 and 30 via knobs 20, 21. Thus, the TIME ON 23 will be controlled in accordance with the setting of the resistor 29. Conversely, the TIME OFF will be set by the setting of resistor 30. The signal is therefore a square wave signal, with the switching cycle controlled by the setting of the resistors 29 and 30.

The concepts of the invention provide an improved and unique water bed wave generating and control system, which can silently create a large, small or vibrating wave.

Various modes of carrying out the invention are contemplated as being within the scope of the appended claims particularly pointing out and distinctly claiming the subject matter which is regarded as the invention.

I claim:

1. A water bed comprising, in combination:

(a) a bed frame having side walls (2, 3) and end walls (4, 5), (b) a water mattress (6) mounted in said frame and including an envelope (7) enclosing a quantity of water (8), said envelope having a normally horizontal top surface, (c) selectively actuatable wave generation means mounted to one end wall (4 or 5) of said frame for engaging said mattress to create desired undulations therein, said wave generation means including:

(1) a solenoid (14) having an output shaft (15) extending therefrom and with said solenoid shaft having an outer end disposed in close proximity to said mattress, (2) said solenoid shaft being disposed at an acute angle to the vertical, (3) a pusher member (16) disposed on said outer end of said solenoid shaft and with said pusher member being inclined at an acute angle of about 15°–20° to said top surface of said mattress envelope so that said member faces generated waves approaching said member from the other end wall remote from said one end wall, (4) and control means to reciprocate said solenoid shaft so that the reciprocable motion of said solenoid shaft is transmitted directly from said solenoid shaft through said pusher member to said top surface of said mattress envelope, (5) said control means providing a generally square electrical wave control signal and further providing independent variable TIME ON and TIME OFF modes.

* * * * *